US012691913B2

(12) United States Patent
Luchini et al.

(10) Patent No.: US 12,691,913 B2
(45) Date of Patent: Jul. 28, 2026

(54) SELF-CONTAINED POWER SOURCE FOR RAILCARS

(71) Applicant: Intramotev Inc., Saint Louis, MO (US)

(72) Inventors: Timothy Luchini, Saint Louis, MO (US); Corey Vasel, Arnold, MO (US); Alex Peiffer, Columbus, OH (US); Stephen Sommerlot, Lansing, MI (US)

(73) Assignee: Intramotev Inc., St. Louis, MO (US)

( * ) Notice: Subject to any disclaimer, the term of this patent is extended or adjusted under 35 U.S.C. 154(b) by 799 days.

(21) Appl. No.: 18/063,398

(22) Filed: Dec. 8, 2022

(65) Prior Publication Data

US 2023/0174120 A1 Jun. 8, 2023

Related U.S. Application Data

(60) Provisional application No. 63/287,236, filed on Dec. 8, 2021.

(51) Int. Cl.

| | |
|---|---|
| ***B61D 43/00*** | (2006.01) |
| ***B61C 3/02*** | (2006.01) |
| ***B61C 9/50*** | (2006.01) |
| ***B61C 13/00*** | (2006.01) |
| ***B61C 17/06*** | (2006.01) |
| ***B61D 49/00*** | (2006.01) |
| ***B61H 9/00*** | (2006.01) |

(52) U.S. Cl.

CPC ..... *B61D 43/00* (2013.01); *B61C 3/02* (2013.01); *B61C 9/50* (2013.01); *B61C 13/00* (2013.01); *B61C 17/06* (2013.01); *B61D 49/00* (2013.01); *B61H 9/00* (2013.01)

(58) Field of Classification Search

CPC .. B61C 3/02; B61C 9/50; B61C 13/00; B61C 17/06; B61D 43/00; B61D 49/00; B61H 9/00

See application file for complete search history.

(56) References Cited

U.S. PATENT DOCUMENTS 2,412,848 A * 12/1946 Warren ..... F01D 25/16 105/36
3,886,870 A * 6/1975 Pelabon ..... B61C 7/04 105/49
6,236,185 B1 * 5/2001 Hines ..... H02J 7/32 320/101

(Continued)

*Primary Examiner* — Robert J McCarry, Jr.
(74) *Attorney, Agent, or Firm* — McDonnell Boehnen Hulbert & Berghoff LLP

(57) ABSTRACT

Example embodiments relate to implementing self-contained power sources for railcars. A railcar may include an air turbine that comprises a generator. The air turbine converts mechanical energy received from air to electrical energy by way of the generator. In some implementations, the air turbine is selectably coupled to the air brake system of the railcar and can convert mechanical energy received from pressurized air of the air brake system. The railcar can further include a pneumatic valve and a controller that can cause the pneumatic valve to open when the air pressure of the air brake system is at or above a predetermined level. Opening the pneumatic valve provides pressurized air to the air turbine from the air brake system and/or an exhaust pipe. The air turbine is a Wells turbine or a ram air turbine in some examples.

18 Claims, 8 Drawing Sheets

(56) References Cited

U.S. PATENT DOCUMENTS

| | | | | |
|---|---|---|---|---|
| 2012/0306218 | A1* | 12/2012 | Bodnar, Jr. | H02P 9/04<br>290/40 B |
| 2018/0037205 | A1* | 2/2018 | Contreras | B60T 1/16 |
| 2021/0199062 | A1* | 7/2021 | Blythe | F02B 39/10 |

* cited by examiner

SELF-CONTAINED POWER SOURCE FOR RAILCARS

CROSS REFERENCE TO RELATED APPLICATION

The present patent application claims priority to U.S. Provisional Patent Application No. 63/287,236 filed Dec. 8, 2021, which is hereby incorporated by reference in its entirety.

FIELD

The present disclosure relates generally to rail transportation systems, in particular to a self-contained power source that provides electrical power to equipment on one or more railcars.

BACKGROUND

The rail industry is being increasingly tasked with providing more passive electrical devices on individual railcars. Such passive devices include, without limitation, global position satellite (GPS) receivers, status monitoring equipment, and communications receivers and transmitters. The passive devices are used in support of improvements in railcar tracking and traceability, safety, and security. These improvements are of increasing importance to railroads and their customers.

Installing electrification and wiring for the entire length of a train to supply electrical power to the passive devices on each railcar is expensive and complicated. The approach may even be impossible when considering the more than 1.6 million railcars operating on the U.S. interchange in 2021. An alternate approach is to place individual battery power supplies on each railcar; however, wiring them to a common charging source obviates the advantage of individual power supplies. The batteries could be connected to individual charging sources while not in motion, but this is time-consuming and laborious. Accordingly, there is a need to provide electrical power to railcars that does not require wiring an additional connection the length of the train. There is a further need for a power source that is relatively low-cost, since it could be deployed on a plurality of railcars on a train set.

SUMMARY

In a first aspect, a railcar is described. The railcar includes an air turbine that comprises a generator. The air turbine converts mechanical energy received from air to electrical energy by way of the generator.

In a second aspect, a bidirectional power source is described. The bidirectional power source includes an air turbine and an energy storage system. The air turbine comprises a generator. The air turbine converts mechanical energy received from air to electrical energy by way of the generator. The energy storage system is electrically coupled to the generator, wherein the bidirectional power source is removably attachable to a railcar.

In a third aspect, a method for charging an energy storage system coupled to a railcar is described. The method involves causing, by a controller, a pneumatic valve to open when an air pressure of an air brake system of the railcar is at or above a predetermined level. Causing the pneumatic valve to open provides pressurized air to an air turbine from at least one of the air brake system or an exhaust pipe of the railcar, wherein the air turbine is coupled to the railcar.

A self-contained power source for railcars is disclosed according to an embodiment of the present disclosure. In one embodiment an air turbine is selectably coupled to an air brake system of the railcar and drives a generator. In another embodiment a ram air turbine is exposed to the wind stream flowing over a moving railcar and drives a generator. In another embodiment a Wells turbine, which turns in the same direction regardless of airflow is placed in the ram air intake. These sources of electrical energy are local to the railcar and require no ongoing labor to connect or charge them. The local power sources provide several additional potential benefits. For example, with a local power source on a railcar the passive devices on the railcar that require power are able to operate even when not connected to a locomotive or other remote power source. In addition, no additional labor or incremental connections are required of the crew tasked with assembling train sets, saving time and labor.

DETAILED DESCRIPTION

A moving train has kinetic energy, which needs to be removed in order for it to slow down and stop. This is typically accomplished by converting the kinetic energy to heat, by applying a contact material to rotating wheels of the train or to discs attached to the axles. The contact material creates friction and converts the kinetic energy into heat. In response, the wheels slow down and the train stops.

Most trains are equipped with braking systems that use compressed air as the force to push contact material onto the wheels or discs. These systems are known as air brakes or pneumatic brakes. The compressed air is transmitted along the train through a network of pneumatic lines. Changing the level of air pressure in a pneumatic "brake pipe" causes a change in the state of a brake on each railcar of the train. The air pressure can apply the brake, release it or hold it on after a partial application. Some embodiments utilize the braking system to generate electrical power, as discussed further below.

Figure 1:
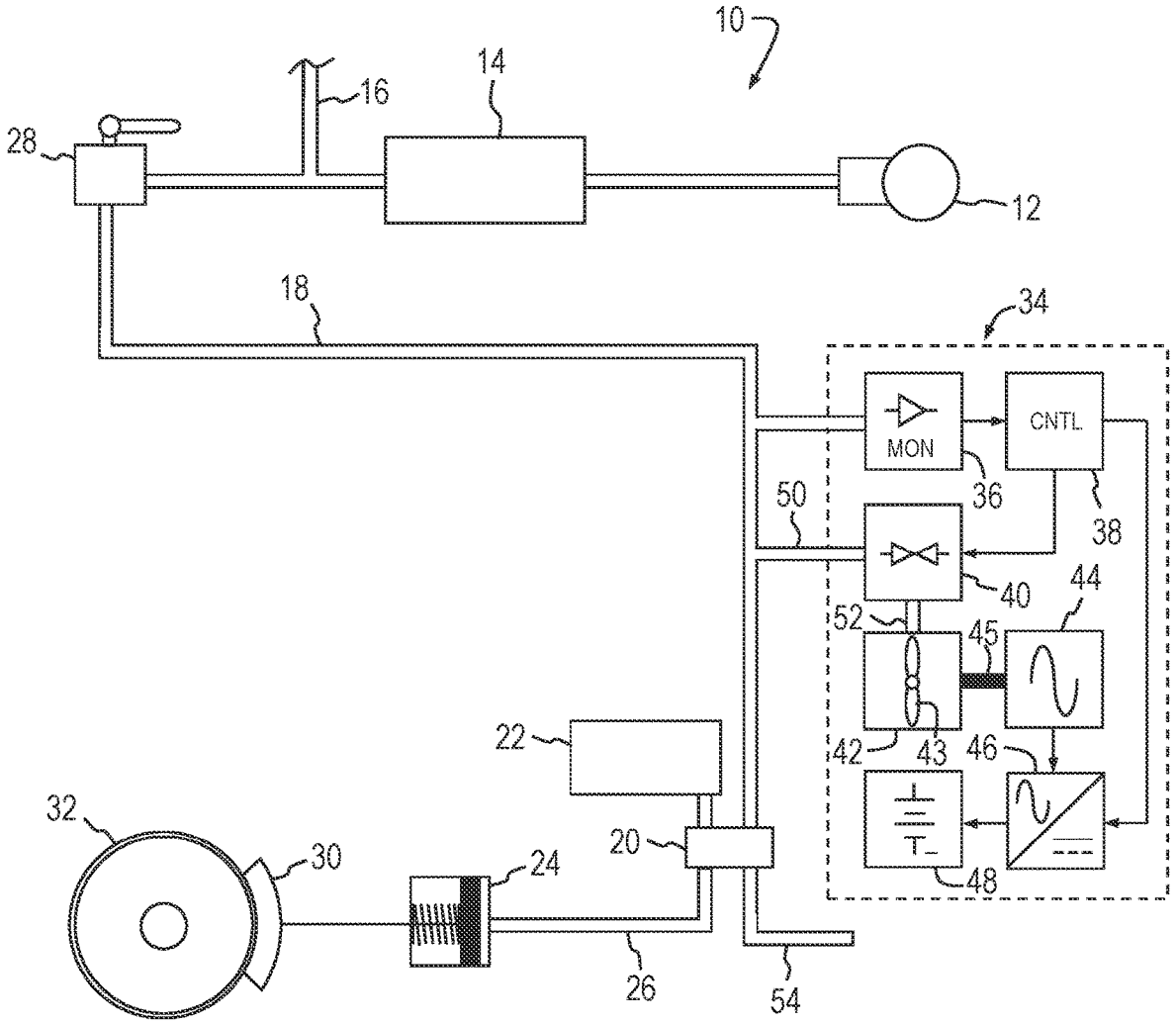
FIG. 1 is a schematic diagram of a power source driven by an air brake system of a train prior to the recharge line on the air brake reservoir on the railcar, according to one or more example embodiments.

A self-contained power source 10 for railcars is shown in FIG. 1 according to an embodiment. The self-contained power source 10 can be positioned on freight cars and other types of railcars. Air is drawn into a compressor 12, compressed, and stored in a main reservoir 14, which is commonly found on locomotive power units. Compressed air from main reservoir 14 is distributed along the railcars of a train through a main reservoir pipe 16 that is connected to the brakes of each railcar in the train. On each railcar, a brake pipe 18 is connected through a triple valve 20 to an auxiliary reservoir 22 which stores compressed air for local use on that railcar's brake system. The flow of air between auxiliary reservoir 22 and a brake cylinder 24 (via a brake cylinder pipe 26) is controlled through triple valve 20. Control of triple valve 20, in turn, is achieved by varying the pressure in brake pipe 18 with a brake valve 28 located in the driver's cab and connected to the brake pipe. Increasing the pressure in brake pipe 18 causes the pressure to increase in auxiliary tank 22 and brake cylinder pipe 26, causing brake cylinder 24 to move a contact brake material 30 away from a wheel 32 of a railcar (not shown for clarity) and allowing the wheel to freely rotate. Conversely, decreasing the pressure in brake line 18 causes the pressure to decrease in auxiliary tank 22 and brake cylinder pipe 26, causing brake cylinder 24 to move contact material 30 toward wheel 32 and limiting rotation of the wheel with friction.

An inherent safety feature of the air brake system in regions like Europe is that the brakes will automatically apply with the loss of air pressure; thus, any railcars that become disengaged from a train's air brake system will automatically brake instead of potentially becoming runaway railcars. Air brake systems are the opposite in the U.S. In the U.S., air brake systems fail open when the air brake is empty instead of failing safely like the European system.

For this reason there is an additional hand brake on U.S. railcars that pulls a chain and mechanically applies the brakes. This is typically used to prevent movement of parked cars. A schematic diagram of a power supply 34 of power source 10 is shown in FIG. 1 according to an embodiment. Power supply 34 comprises a pressure monitor 36, a controller 38, a pneumatic valve 40, a turbine 42, a generator 44, a rectifier/regulator 46, and a battery 48.

Monitor 36 is coupled to brake pipe 18 and generates an electrical pressure signal that corresponds to the amount of pressure in the brake pipe. Monitor 36 may be any suitable device that is capable of measuring air pressure and generating a corresponding electrical air pressure signal. The air pressure signal may be in any desired format such as, without limitation, an analog or digital signal, including standard or proprietary data bus signals.

Controller 38 receives the electrical air pressure signal from monitor 36 and controls operation of valve 40 in a predetermined manner. Controller 38 may include any suitable arrangement of analog and/or digital circuitry. For example, controller 38 may include one or more microprocessors, and may include a set of predetermined operating instructions in hard-code, firmware, software or other media.

Pneumatic valve 40 receives pressurized air from brake pipe 18 via a turbine input pipe 50 and selectably conveys the pressurized air to turbine 42 through a turbine output pipe 52. Pneumatic valve 40 may be configured to switch to an open or "on" state and allow pressurized air from brake pipe 18 to flow there through in response to an appropriate signal from controller 38. Pneumatic valve 40 may also be configured to switch to an "off" state and block pressurized air from brake pipe 18 from flowing there through in response to an appropriate signal from controller 38. Pneumatic valve 40 may also be configured with a biasing mechanism to urge the valve to either an on or off state in the absence of a signal from controller 38. In yet another embodiment pneumatic valve 40 may be configured to be modulated to an on state, an off state, or any state therebetween in response to appropriate control signals from controller 38.

Turbine 42 receives the pressurized air from pneumatic valve 40. The pressurized air flows through turbine 42 and strikes fan blades 43 of the turbine, causing the turbine to move rotatably.

Generator 44 is mechanically coupled to turbine 42 with a shaft 45, causing a rotor (not shown) of the generator to rotate and develop electrical power. Generator 44 may be a field-type generator, an alternator, or any other suitable device configured to convert mechanical movement to electrical energy.

Rectifier/regulator 46 receives the electrical power from generator 44. If the electrical power is in the form of an alternating current (AC), rectifier/regulator 46 converts the AC power to direct current (DC) voltage. The rectifier portion of rectifier/regulator 46 may be omitted if the received electrical power is in DC form. The rectifier portion may also optionally be left in place, in which case the DC power will pass therethrough to the regulator portion. The regulator portion of rectifier/regulator 46 regulates the DC current to a level suitable for charging battery 48. The regulator portion may be any suitable arrangement of analog and/or digital circuitry, and may operate independently or under the control of controller 38 as shown in FIG. 1.

Battery 48 receives the charge current from rectifier/regulator 46 and is recharged. Alternatively, the charge condition of battery 48 is maintained with the charge current. Battery 48 may be any suitable type or battery or batteries, such as lead-acid, nickel-cadmium (NICAD) and lithium-ion (LITH-ION). Battery 48 may also be or include capacitive storage devices, such as ultra-capacitors.

With continued reference to FIG. 1, in operation of power supply 34 controller 38 receives an air pressure signal from monitor 36 and acts accordingly. For example, controller 38 may be configured to open pneumatic valve 40 under certain conditions, such as when the air pressure in brake pipe 18 is at or above a predetermined level. When pneumatic valve 40 is open, pressurized air supplied to pneumatic valve 40 from air brake pipe 18 by a turbine input pipe 50 is directed to turbine 42 via a turbine output pipe 52, causing the turbine to rotate and in turn causing generator 44 to likewise rotate. This rotating mechanical motion is converted to electrical energy. The electrical energy is supplied to rectifier/regulator 46, which rectifies and conditions the voltage and current of the electrical energy to levels suitable for charging battery 48 connected thereto. Any suitable load, such as a GPS receiver (not shown) may be connected to and powered by battery 48.

Figure 2:
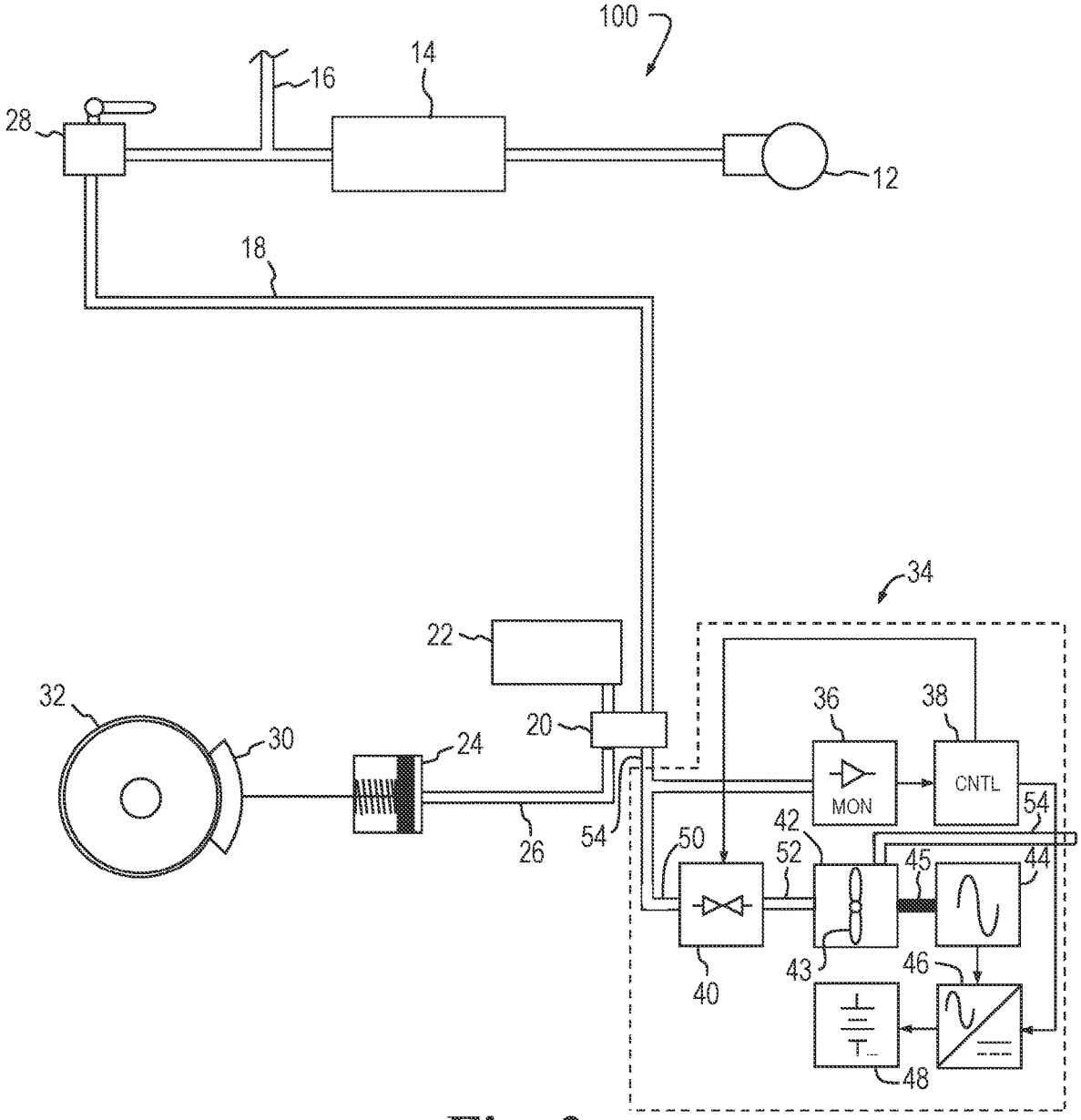
FIG. 2 is a schematic diagram of a power source driven by an air brake system of a train after the recharge line and running off a bleed airline on the railcar, according to one or more example embodiments.

A self-contained power source 100 for railcars is shown in FIG. 2 according to an alternate embodiment. Power source 100 is configured such that pressure monitor 36 and turbine input pipe 50 of power supply 34 are coupled to an exhaust pipe 54 of triple valve 20. Power source 100 is otherwise similar to power source 10.

Figure 3:
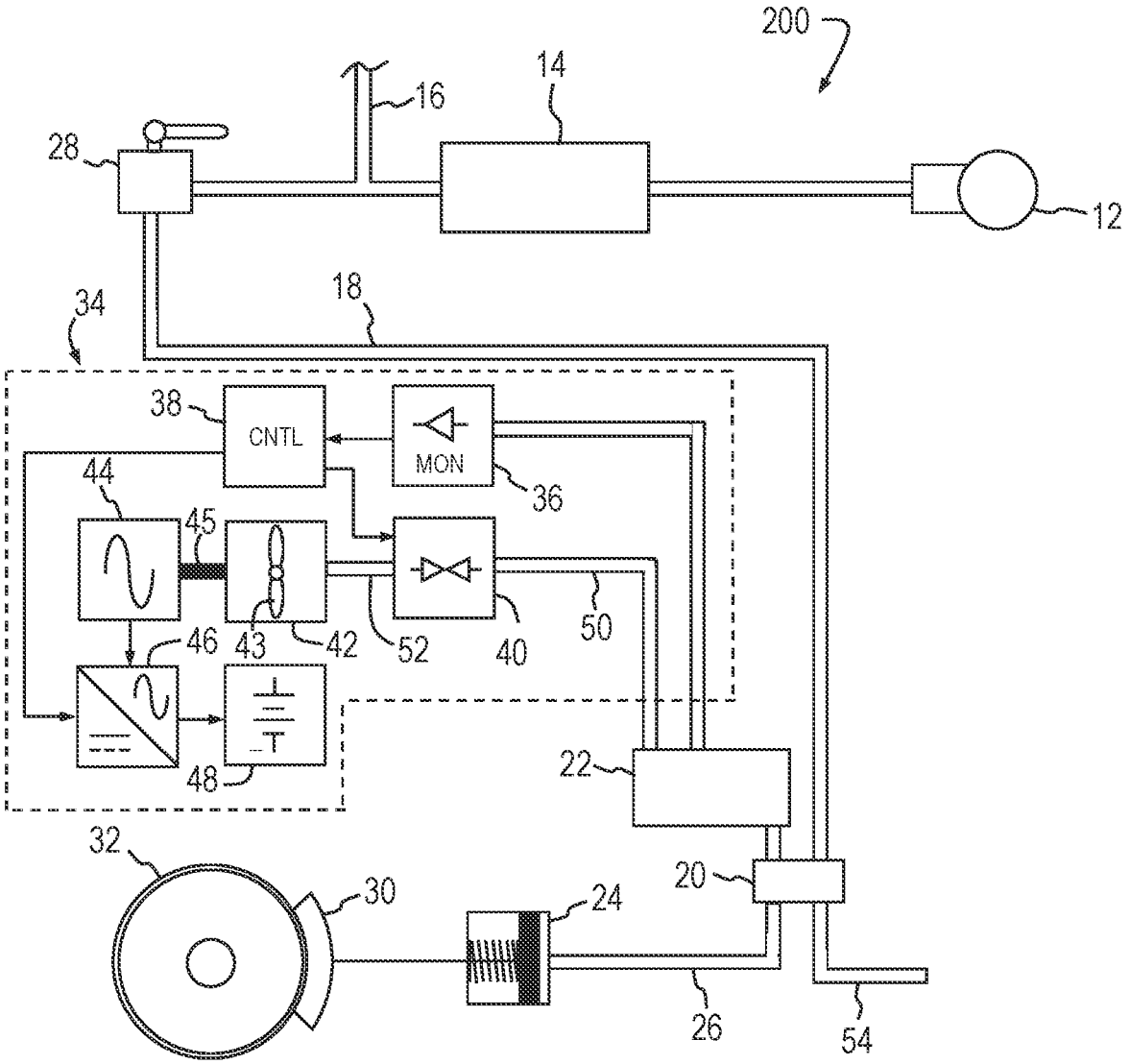
FIG. 3 is a schematic diagram of a power source driven by an air brake system of a train, according to one or more example embodiments.

A self-contained power source 200 for railcars is shown in FIG. 3 according to another alternate embodiment. Power source 200 is configured such that monitor 36 and turbine input pipe 50 of power supply 34 are coupled to auxiliary reservoir 22. Power source 200 is otherwise similar to power source 10.

Figure 4:
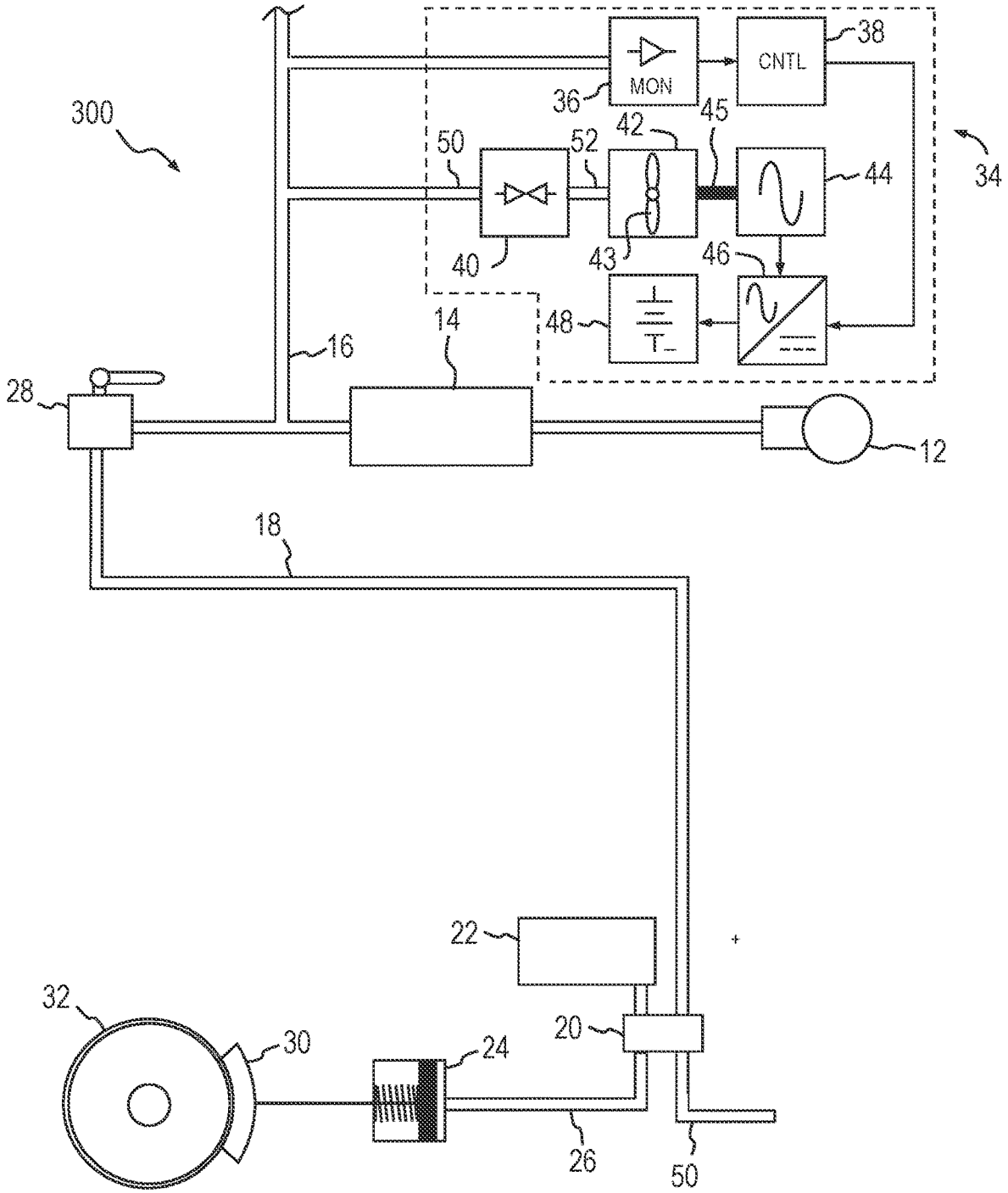
FIG. 4 is a schematic diagram of a power source driven by an air brake system of a train, according to one or more example embodiments.

A self-contained power source 300 for railcars is shown in FIG. 4 according to another alternate embodiment. Power source 300 is configured such that monitor 36 and turbine input pipe 50 of power supply 34 are coupled to main reservoir pipe 16. Power source 300 is otherwise similar to power source 10.

Figure 5:
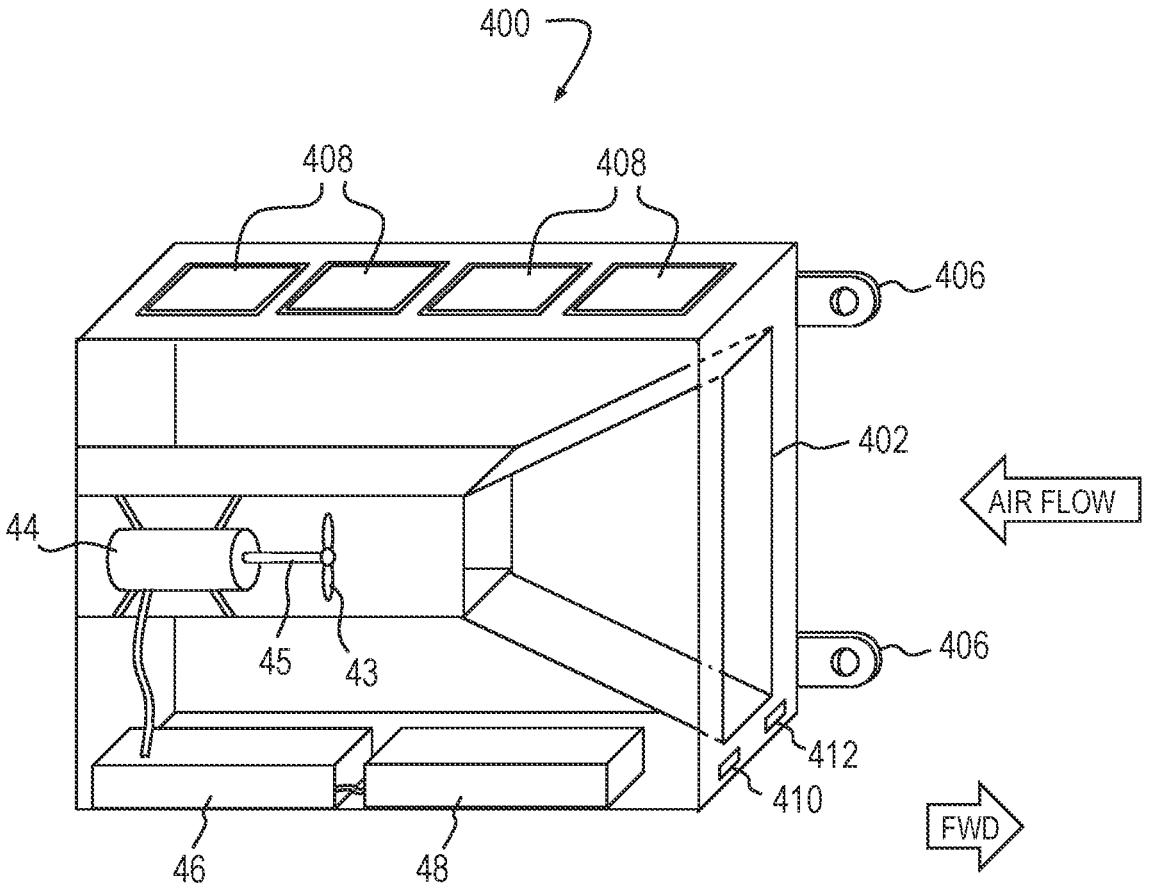
FIG. 5 is a unidirectional wind stream driven power source, according to one or more example embodiments.

A power source 400 is shown in FIG. 5 according to yet another alternate embodiment. A ram air input 402 is exposed to air flowing over a railcar (not shown). The air flows into the ram air input 402 and is directed to fan blades 43 of turbine 42.

Turbine 42 receives the pressurized air from ram air input 402. The pressurized air impinges fan blades 43 of turbine 42 and causes the turbine to move rotatably.

Generator 44 is mechanically coupled to turbine 42 by shaft 45, causing the generator to develop electrical power as previously described. Generator 42 may be any suitable field-type generator, alternator, or any other device configured to convert mechanical movement to electrical energy.

Rectifier/regulator 46 receives the electrical energy from generator 44 and converts the energy to direct current (DC) from alternating current (AC) if not already in DC form, and regulates the current to a level suitable for a battery 48.

Battery 48 receives the charge current from rectifier/regulator 46. Battery 48 may be any suitable type or battery or batteries, such as lead-acid, nickel-cadmium (NICAD) and lithium-ion (LITH-ION). Battery 48 may also be or include capacitive storage devices, such as ultracapacitors.

With continued reference to FIG. 5, in operation of power source 400 air flows into ram air input 402 when a railcar to which the power source is attached is in motion. The flowing air is directed to turbine 42 and impinges fan blades 43, causing the turbine to rotate. Coupling shaft 45 in turn causes the generator 44 to likewise rotate. This rotating mechanical motion is converted to electrical energy. The electrical energy is supplied to rectifier/regulator 46, which rectifies and conditions the voltage and current of the electrical energy to levels suitable for charging battery 48 connected thereto.

Ram air input 402 may be unidirectional as shown in FIG. 5. In this configuration ram air input 402 is directed forwardly, i.e., facing the direction of travel of the railcar to which power source 400 is attached, Alternatively, ram air input 402 may be bidirectional as shown by a power source 500 in FIG. 6 with fan blades 43 of turbine 42 configured to be driven by either of two ram air inputs 502, 504. Turbine 42 may optionally be a Wells turbine, which turns in the same direction regardless of the direction of airflow. The ram air inputs 202 are oriented forwardly and rearwardly, allowing for ram air input to power source 400 regardless of the direction of travel of the railcar in a train.

Power sources 400, 500 may be attached to a railcar in any convenient manner, such as with fasteners securing mounting tabs 406 (FIGS. 5, 6) or a mounting bracket mounted to the railcar to which the power source is selectably attached. Alternatively, power source 200 may be selectably attached to a railcar with magnets.

In some embodiments of the present invention power sources, 400, 500 may further include one or more solar panels 408. Solar panels 408 may be electrically connected to rectifier/regulator 46 or directly to battery 48 as desired. A controller 38 similar to the controller of FIG. 1 may also be utilized to manage charging of battery 48 with energy from solar panels 408.

Figure 7:
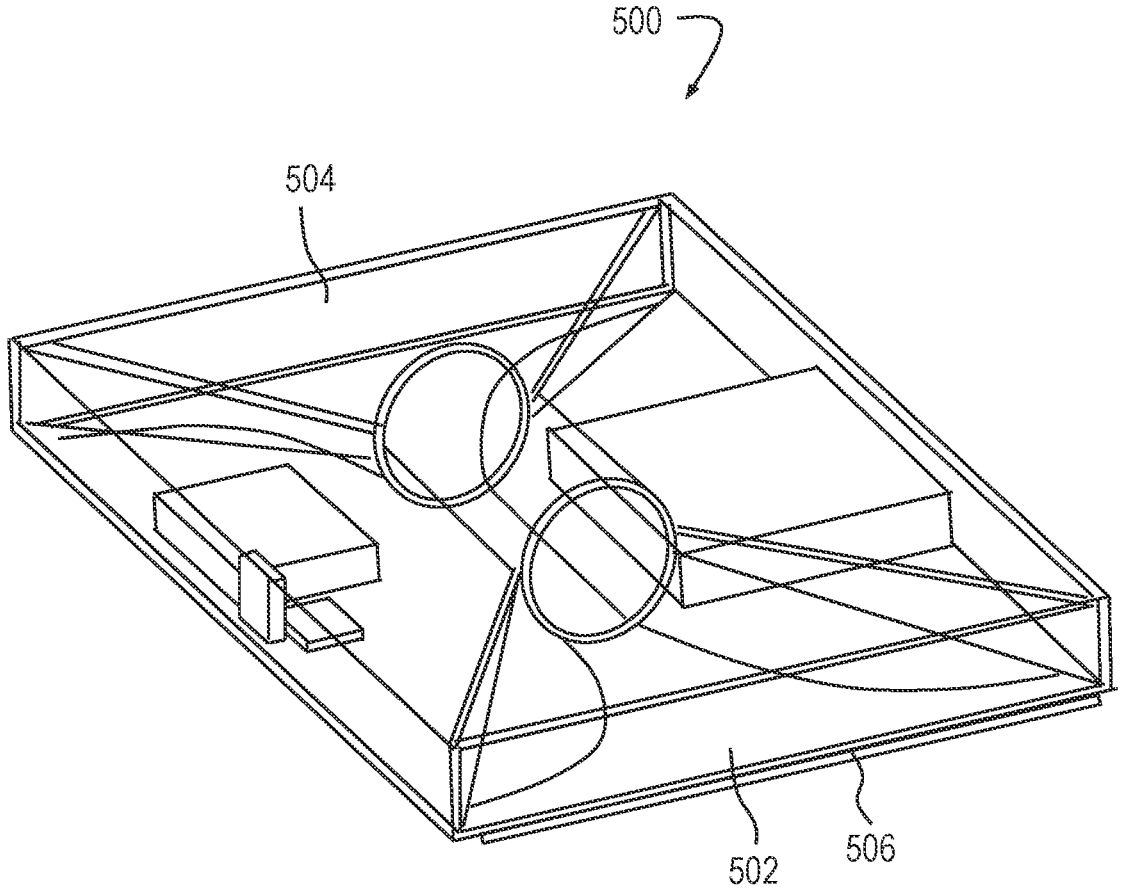
FIG. 7 is a sketch of an example packaging arrangement of the power source shown in FIG. 6, according to one or more example embodiments.

A non-limiting implementation of bidirectional power source 500 is shown in FIG. 7 and uses one or more magnets 506 to attach the power source to a railcar. The magnets 506 may also be used to attach a power source to a railcar.

Figure 6:
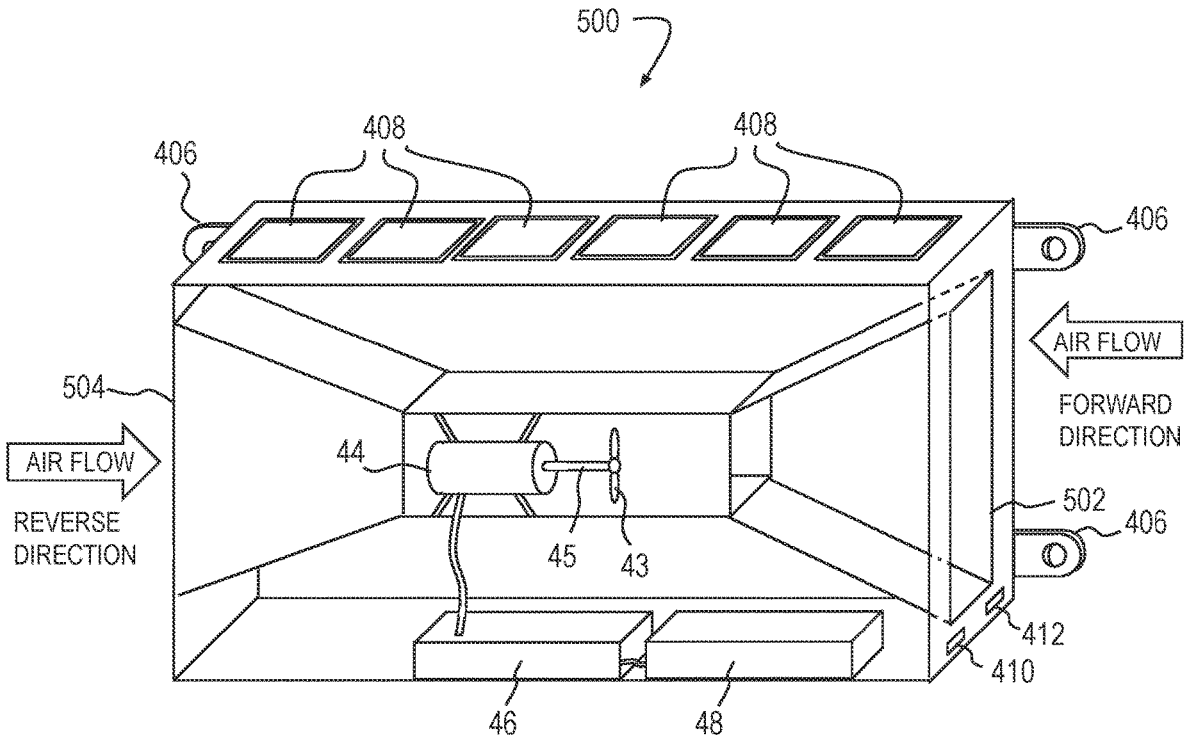
FIG. 6 is a bidirectional wind stream driven power source, according to one or more example embodiments.

In addition to powering passive devices on a railcar, any of the power sources discussed herein may further include a 5 volt USB power connector jack 410 and a 12 volt DC power connector jack 412 to selectably power external or portable devices. Examples are shown in FIGS. 5 and 6.

Controller 38 and pneumatic valve 40 may optionally be omitted in some power source configurations, if desired. For example, power source 100 of FIG. 2 may be coupled to exhaust pipe 54, and will drive turbine 42 whenever triple valve 20 is in a state that diverts pressurized air to the exhaust pipe 54.

In some examples, the railcar has a structure and at least one bogie attached to the structure. The bogie includes at least one axle with a motor coupled to the axle. As such, the motor can use electrical energy from the energy storage system to rotate the axle.

Figure 8:
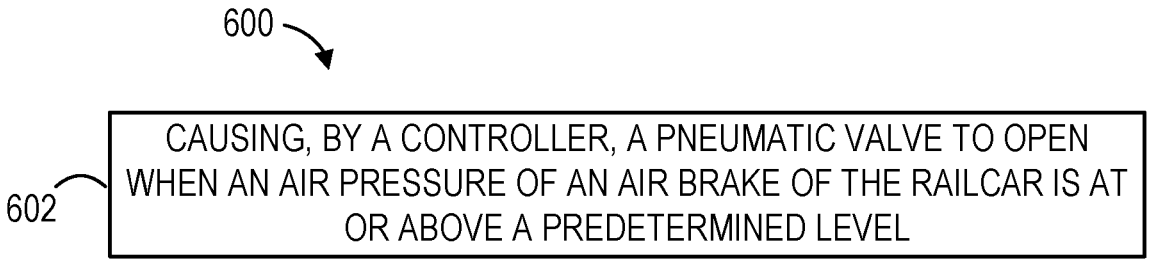
FIG. 8 is a flowchart of a method for operating a self-contained power source installed on a railcar, according to one or more example embodiments

FIG. 8 is a flowchart of a method for operating a self-contained power source installed on a railcar. Method 600 represents an example method that may include one or more operations, functions, or actions, as depicted by one or more of block 602, which may be carried out by any of the systems, devices, and/or vehicles shown in FIGS. 1-7.

Block 602 of method 600 involves causing, by a controller, a pneumatic valve to open when an air pressure of an air brake system of the railcar is at or above a predetermined level. In particular, causing the pneumatic valve to open provides pressurized air to an air tribune from at least one of the air brake system or an exhaust pipe of the railcar. As such, the air turbine is coupled to the railcar.

From the above description, those skilled in the art will perceive improvements, changes, and modifications in example embodiments. Such improvements, changes, and modifications within the skill of the art are intended to be covered. For example, power sources for railcars may include solar, nuclear, waste motion, and piezoelectric conversion from waste heat in the train's braking system. In addition, example embodiments may be used in connection with container shipping via trucking on their air lines. Further, some embodiments, such as the embodiment of FIG. 4, may be used on shipping containers, semi-trucks, and at sea on containers and ships

What is claimed is:

1. A railcar comprising:

an air turbine coupled to an air brake system of the railcar, wherein the air turbine comprises a generator, wherein the air turbine converts mechanical energy received from pressurized air of the air brake system to electrical energy by way of the generator;

an energy storage system electrically coupled to the generator;

a structure having at least one bogie, wherein the bogie comprises an axle; and a motor coupled to the axle, wherein the motor uses electrical energy from the energy storage system to rotate the axle.

2. The railcar of claim 1, further comprising:

a pneumatic valve; and a controller, wherein the controller is operable to carry out operations, the operations comprising:

causing the pneumatic valve to open when an air pressure of the air brake system is at or above a predetermined level.

3. The railcar of claim 2, wherein causing the pneumatic valve to open provides pressurized air to the air turbine from at least one of: the air brake system or an exhaust pipe.

4. The railcar of claim 2, further comprising a pressure monitor coupled to the air brake system, wherein the pressure monitor is configured to generate an electrical pressure signal corresponding to the air pressure in the air brake system, and wherein the controller receives the electrical pressure signal to control the pneumatic valve.

5. The railcar of claim 1, wherein the air turbine comprises a Wells turbine or a ram air turbine.

6. The railcar of claim 1, wherein a wind stream provided by motion of the railcar causes the air turbine to provide mechanical energy to the generator.

7. The railcar of claim 1, wherein the energy storage system comprises a battery.

8. The railcar of claim 1, further comprising:

a rectifier/regulator electrically coupled to the generator, wherein the rectifier/regulator is configured to convert an alternating current (AC) signal from the generator to a direct current (DC) voltage.

9. The railcar of claim 8, further comprising:

at least one solar panel, wherein the at least one solar panel is electrically coupled to the rectifier/regulator.

10. The railcar of claim 8, wherein the rectifier/regulator is further configured to regulate the direct current (DC) voltage to a level suitable for charging the energy storage system.

11. The railcar of claim 1, further comprising at least one of: a 5 volt USB power connector jack or a 12 volt DC power connector jack, electrically coupled to the energy storage system.

12. A bidirectional power source, comprising:

an air turbine selectably coupled to an air brake system of a railcar, wherein the air turbine comprises a generator, wherein the air turbine converts mechanical energy received from pressurized air of the air brake system to electrical energy by way of the generator; and an energy storage system, wherein the energy storage system is electrically coupled to the generator, wherein the bidirectional power source is removably attachable to the railcar.

13. The bidirectional power source of claim 12, wherein the railcar is a freight car.

14. The bidirectional power source of claim 13, wherein the bidirectional power source is removably attachable to the railcar using at least one magnet.

15. The bidirectional power source of claim 12, wherein the energy storage system comprises a battery.

16. The bidirectional power source of claim 12, further comprising:

a pneumatic valve; and a controller, wherein the controller is operable to carry out operations, the operations comprising:

causing the pneumatic valve to open when an air pressure of the air brake system is at or above a predetermined level.

17. The bidirectional power source of claim 16, wherein causing the pneumatic valve to open provides pressurized air to the air turbine from at least one of: the air brake system or an exhaust pipe.

18. A method for charging an energy storage system coupled to a railcar, the method comprising:

causing, by a controller, a pneumatic valve to open when an air pressure of an air brake system of the railcar is at or above a predetermined level, wherein causing the pneumatic valve to open provides pressurized air to an air turbine from at least one of the air brake system or an exhaust pipe of the air brake system of the railcar, wherein the air turbine is coupled to the railcar and comprises a generator that converts mechanical energy from the pressurized air to electrical energy for charging the energy storage system.

* * * * *